US009411252B2

(12) United States Patent
Murakami et al.

(10) Patent No.: US 9,411,252 B2
(45) Date of Patent: Aug. 9, 2016

(54) ELECTROPHOTOGRAPHIC PHOTOSENSITIVE MEMBER, METHOD OF PRODUCING THE SAME, PROCESS CARTRIDGE, AND ELECTROPHOTOGRAPHIC APPARATUS

(71) Applicant: CANON KABUSHIKI KAISHA, Tokyo (JP)

(72) Inventors: Mai Murakami, Kashiwa (JP); Kenichi Kaku, Newcastle Upon Tyne (GB); Wataru Kitamura, Abiko (JP); Yuka Ishiduka, Suntou-gun (JP); Ryoichi Tokimitsu, Kashiwa (JP); Hideaki Nagasaka, Suntou-gun (JP); Takeshi Murakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/361,965

(22) PCT Filed: Nov. 28, 2012

(86) PCT No.: PCT/JP2012/081431

§ 371 (c)(1),
(2) Date: May 30, 2014

(87) PCT Pub. No.: WO2013/081171

PCT Pub. Date: Jun. 6, 2013

(65) Prior Publication Data

US 2014/0342276 A1 Nov. 20, 2014

(30) Foreign Application Priority Data

Nov. 30, 2011 (JP) ..... 2011-262128
Nov. 21, 2012 (JP) ..... 2012-254808

(51) Int. Cl.
*G03G 5/14* (2006.01)
*G03G 5/10* (2006.01)

(52) U.S. Cl.
CPC ..... *G03G 5/142* (2013.01); *G03G 5/102* (2013.01); *G03G 5/144* (2013.01)

(58) Field of Classification Search
CPC ..... G03G 5/14; G03G 5/142; G03G 5/144
See application file for complete search history.

(56) References Cited

FOREIGN PATENT DOCUMENTS

| | | | | |
|---|---|---|---|---|
| JP | 3-013960 A | | 1/1991 | |
| JP | 3-209261 A | | 9/1991 | |
| JP | H03-209262 A | | 9/1991 | |
| JP | 9-96916 A | | 4/1997 | |
| JP | 2004-191868 A | | 7/2004 | |
| JP | 2011-059518 | * | 3/2011 | ..... G03G 5/047 |
| JP | 2011-059518 A | | 3/2011 | |

OTHER PUBLICATIONS

Translation of JP 2011-059518 publsihed Mar. 2011.*
"The Journal of the Japanese Society for Dental Materials and Devices," vol. 11, No. 6, pp. 916-921(1992), Shigeaki Kurata and Noboru Yamazaki.

* cited by examiner

*Primary Examiner* — Peter Vajda
(74) *Attorney, Agent, or Firm* — Canon U.S.A., Inc., IP Division

(57) ABSTRACT

An electrophotographic photosensitive member includes an undercoat layer containing a silane coupling agent having a divalent group represented by —NH— and an urethane resin. The modulus of elastic deformation (we/wt) of a surface of the undercoat layer satisfies formula (X), where the modulus of elastic deformation is measured by a universal hardness test.

11 Claims, 2 Drawing Sheets

ELECTROPHOTOGRAPHIC PHOTOSENSITIVE MEMBER, METHOD OF PRODUCING THE SAME, PROCESS CARTRIDGE, AND ELECTROPHOTOGRAPHIC APPARATUS

TECHNICAL FIELD

The present invention relates to an electrophotographic photosensitive member, a method of producing the electrophotographic photosensitive member, a process cartridge, and an electrophotographic apparatus.

BACKGROUND ART

Organic electrophotographic photosensitive members (hereinafter "electrophotographic photosensitive members") have been widely available on the market with rapidly spreading use of devices such as copiers and laser beam printers. A typical electrophotographic photosensitive member includes an undercoat layer containing metal oxide particles and a photosensitive layer formed on the undercoat layer.

The undercoat layer can contain a thermosetting resin, rather than an alcohol-soluble resin, as a binder resin for reduced dependence on ambient conditions such as temperature and humidity.

It is also known that the surface of the metal oxide particles contained in the undercoat layer can be treated with a silane compound (silane coupling agent) for improved electrophotographic properties and reduced dependence on ambient conditions of the electrophotographic photosensitive member.

Silane coupling agents have a silicon atom to which one to three hydrolyzable groups are attached. Often, silane coupling agents having a silicon atom to which three hydrolyzable groups are attached are used for electrophotographic photosensitive members. NPL 1 discloses the treatment effect and waterfastness of silane coupling agents with varying numbers of hydrolyzable groups. This literature shows that, of silane coupling agents having a 3-methacryloxy group and one to three hydrolyzable groups, i.e., chloro groups, those having three hydrolyzable groups produce the greatest treatment effect.

PTL 1 discloses an undercoat layer containing a binder resin and metal oxide particles whose surface is treated with a coupling agent having a substituted or unsubstituted amino group (silane coupling agent having a divalent group represented by —NH—). The binder resin used in PTL 1 is a polyamide resin. Polyamide resins tend to cause potential variation with ambient changes because of their high water absorbency, particularly under a high-temperature, high-humidity environment or a low-temperature, low-humidity environment.

PTL 2 discloses an undercoat layer for electrophotographic photosensitive members that contains a thermosetting resin and metal oxide particles. The thermosetting resin is an urethane resin, specifically, an urethane resin obtainable by polymerization of an isocyanate compound and a polyvinyl acetal resin. The metal oxide particles are treated with a coupling agent having an amino group (silane coupling agent having a divalent group represented by —NH—). As disclosed, this reduces an increase in residual potential after repeated use of electrophotographic photosensitive members or with ambient changes.

CITATION LIST

Patent Literature

PTL 1 Japanese Patent Laid-Open No. 9-96916
PTL 2 Japanese Patent Laid-Open No. 2004-191868

Non Patent Literature

NPL 1 "The Journal of the Japanese Society for Dental Materials and Devices," Vol. 11, No. 6, pp. 916-921(1992)

SUMMARY OF INVENTION

Technical Problem

The use of a silane coupling agent having a divalent group represented by —NH—, however, tends to allow moisture to be deposited on the metal oxide particles. Research by the inventors has demonstrated that the undercoat layer disclosed in PTL 2, which contains a thermosetting resin (urethane resin) and a silane compound (silane coupling agent) having a divalent group represented by —NH—, easily peels off a metallic surface of a support under a high-temperature, high-humidity environment. That is, the undercoat layer easily peels off a metallic surface of a support under a high-temperature, high-humidity environment, or after an electrophotographic photosensitive member exposed to such an environment for an extended period of time is repeatedly used. The research has also demonstrated that this peeling results in a larger potential variation.

The present invention provides an electrophotographic photosensitive member that includes an undercoat layer containing a silane compound (silane coupling agent) having a divalent group represented by —NH—, metal oxide particles, and an urethane resin and that has improved resistance to peeling of the undercoat layer off a metallic surface of a support under a high-temperature, high-humidity environment and reduced potential variation. The present invention also provides a method of producing such an electrophotographic photosensitive member and a process cartridge and electrophotographic apparatus including such an electrophotographic photosensitive member.

Solution to Problem

Research by the inventors has revealed that peeling under a high-temperature, high-humidity environment can be inhibited by controlling the humidity dependence of the modulus of elastic deformation of the undercoat layer.

A first aspect of the present invention relates to an electrophotographic photosensitive member including a support having a metallic surface, an undercoat layer formed directly on the metallic surface of the support, and a photosensitive layer formed on the undercoat layer. The undercoat layer contains metal oxide particles whose surface is treated with a silane compound having a divalent group represented by —NH— and an urethane resin. The urethane resin is obtainable by polymerization of an isocyanate compound and a polyvinyl acetal resin. A modulus of elastic deformation (we/wt) of a surface of the undercoat layer satisfies the following formula (X), the modulus of elastic deformation being measured by a universal hardness test:

(value of *we/wt* of surface of undercoat layer measured under 23° C., 50% RH environment after keeping under same environment for 24 hours)≥
(value of *we/wt* of surface of undercoat layer measured under 23° C., 50% RH environment after keeping under 50° C., 90% RH environment for 24 hours) (X).

A second aspect of the present invention relates to an electrophotographic photosensitive member including a support having a metallic surface, an undercoat layer formed directly on the metallic surface of the support, and a photosensitive layer formed on the undercoat layer. The undercoat layer contains metal oxide particles whose surface is treated with a compound represented by the following formula (1) and an urethane resin. The urethane resin is obtainable by polymerization of an isocyanate compound and a polyvinyl acetal resin.

[Chem. 1]

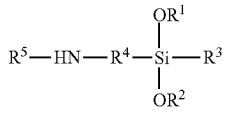

(1)

In the formula (1), $R^1$, $R^2$, and $R^3$ each independently represent an alkyl group having 1 to 3 carbon atoms; $R^4$ represents a divalent group represented by one of the following formulas (R4-1), (R4-2), and (R4-3); and $R^5$ represents a hydrogen atom, a phenyl group, or an alkyl group having 1 to 3 carbon atoms.

[Chem. 2]

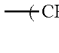

(R4-1)

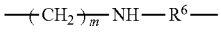

(R4-2)

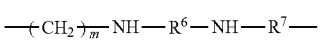

(R4-3)

In the formulas (R4-1), (R4-2), and (R4-3), m is an integer number selected from 1 to 3; and $R^6$ and $R^7$ each independently represent an alkylene group having 1 to 4 carbon atoms.

A third aspect of the present invention relates to a method of producing the electrophotographic photosensitive member according to the second aspect. The method includes the steps of preparing an undercoat layer coating solution by mixing the isocyanate compound, the polyvinyl acetal resin, and the metal oxide particles whose surface is treated with the compound represented by the formula (1); forming a coat for the undercoat layer by using the undercoat layer coating solution; and forming the undercoat layer by heat-drying of the coat.

A fourth aspect of the present invention relates to a method of producing the electrophotographic photosensitive member according to the second aspect. The method includes the steps of preparing an undercoat layer coating solution by mixing and dispersing the isocyanate compound, the polyvinyl acetal resin, the compound represented by the formula (1), and the metal oxide particles; forming a coat for the undercoat layer by using the undercoat layer coating solution; and forming the undercoat layer by heat-drying of the coat.

A fifth aspect of the present invention relates to a process cartridge detachably attachable to a main body of an electrophotographic apparatus. The process cartridge integrally supports the electrophotographic photosensitive member according to any one of the first and second aspects; and at least one device selected from the group consisting of a charging device, a developing device, a transferring device, and a cleaning device.

A sixth aspect of the present invention relates to an electrophotographic apparatus including the electrophotographic photosensitive member according to any one of the first and second aspects; a charging device; an exposure device; a developing device; and a transferring device.

Advantageous Effects of Invention

The above aspects of the present invention can provide an electrophotographic photosensitive member that includes an undercoat layer containing a silane coupling agent (aminosilane coupling agent) having a divalent group represented by —NH—, metal oxide particles, and an urethane resin and that has improved resistance to peeling of the undercoat layer off a metallic surface of a support under a high-temperature, high-humidity environment and reduced potential variation. The above aspects of the present invention can also provide a method of producing such an electrophotographic photosensitive member and a process cartridge and electrophotographic apparatus including such an electrophotographic photosensitive member.

DESCRIPTION OF EMBODIMENTS

Figure 1:
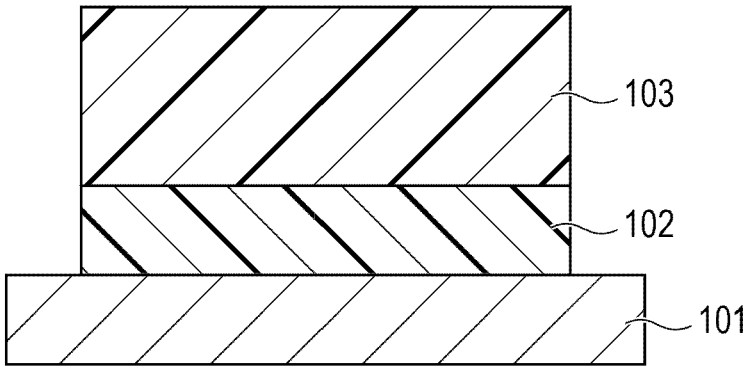
FIG. 1 is a schematic view showing an example of the layer structure of an electrophotographic photosensitive member according to an embodiment of the present invention.

An electrophotographic photosensitive member according to an embodiment of the present invention includes a support, an undercoat layer disposed directly on the support, and a photosensitive layer disposed on the undercoat layer. For example, referring to FIG. 1, the support is indicated at 101, the undercoat layer is indicated at 102, and the photosensitive layer is indicated at 103. The support has a metallic surface.

The undercoat layer of the electrophotographic photosensitive member according to this embodiment contains a silane coupling agent having a divalent group represented by —NH—, metal oxide particles, and an urethane resin. The urethane resin is obtainable by polymerization of an isocyanate compound and a polyvinyl acetal resin. The modulus of elastic deformation (we/wt) of the surface of the undercoat layer measured by a universal hardness test satisfies the following formula (X):

(value of *we/wt* of surface of undercoat layer measured under 23° C., 50% RH environment after keeping under the same environment for 24 hours)≥(value of *we/wt* of surface of undercoat layer measured under 23° C., 50% RH environment after keeping under 50° C., 90% RH environment for 24 hours) (X)

The composition of the undercoat layer is controlled such that the modulus of elastic deformation of the undercoat layer satisfies the formula (X). This improves the resistance to peeling of the undercoat layer off the metallic surface of the support under a high-temperature, high-humidity environment and also reduces potential variation.

One of the causes of peeling is interfacial stress involved in the polymerization of an urethane resin (polymerization of an isocyanate compound and a polyvinyl acetal resin). The polymerization (curing) of the isocyanate compound and the polyvinyl acetal resin causes polymerization shrinkage of the resin. When the undercoat layer is formed on the metallic surface of the support, the polymerization shrinkage of the resin is hindered by its adhesion to the support and internal crosslinked structure. As a result, the resin forming the undercoat layer on the support is forcedly stretched. This causes an interfacial stress at the interface between the support and the undercoat layer, thus contributing to peeling of the undercoat layer off the support.

The inventors believe that the resistance to peeling of the undercoat layer off the metallic surface of the support under a high-temperature, high-humidity environment is improved in this embodiment by the following mechanism.

The inventors have discovered that peeling occurs noticeably under a high-temperature, high-humidity environment with a high moisture level. As moisture enters the interface between a support having a metallic surface and an undercoat layer formed thereon, as well as the undercoat layer itself, the moisture, which adheres more strongly to the metal forming the surface of the support than the urethane resin forming the undercoat layer, gradually decreases the adhesion of the urethane resin to the metal forming the surface of the support. Research by the inventors has also shown that the use of a silane coupling agent having a divalent group represented by —NH—, which is hygroscopic, allows more moisture to enter the undercoat layer, thus promoting its peeling. In summary, the peeling of the undercoat layer off the metallic surface of the support under a high-temperature, high-humidity environment is primarily attributed to the interfacial stress, discussed above, that occurs during the formation of the undercoat layer, and the peeling is promoted by moisture entering the undercoat layer itself and the interface between the support and the undercoat layer.

The inventors have discovered that the tendency of change (increase or decrease) in the modulus of elastic deformation, measured by a universal hardness test, of the surface of the undercoat layer with ambient changes is related to how easily the undercoat layer peels off the support. The modulus of elastic deformation refers to the proportion of elastic deformation energy to the total energy (elastic deformation energy+plastic deformation energy) in a region including both of an elastic deformation region (where an object deformed under a load completely restores its original state after the load is removed) and a plastic deformation region (where the object does not restores its original shape but remains deformed after the load is removed). In the elastic deformation region, the stress is proportional to the deformation; it increases with increasing deformation. In the plastic deformation region, the stress is no longer proportional to the deformation; it increases without a substantial increase in stress. Thus, the elastic deformation region becomes smaller with decreasing modulus of elastic deformation under the same load, and accordingly the stress becomes smaller. This suggests that the stress (interfacial stress) becomes smaller with decreasing modulus of elastic deformation.

The formula (X) states that the undercoat layer has a lower modulus of elastic deformation at high temperature and humidity (under a 50° C., 90% RH environment) than at normal temperature and humidity (under a 23° C., 50% RH environment). Accordingly, the undercoat layer has a lower interfacial stress at high temperature and humidity. This means that an undercoat layer that satisfies the formula (X) has the property of peeling less easily at high temperature and humidity than at normal temperature and humidity because of its lower interfacial stress. Conversely, an undercoat layer that does not satisfy the formula (X) has a higher modulus of elastic deformation at high temperature and humidity than at normal temperature and humidity. This means that the undercoat layer has a higher interfacial stress at high temperature and humidity. Because of the higher interfacial stress, the undercoat layer peels more easily. Thus, if the humidity-dependent change in the modulus of elastic deformation of the undercoat layer does not satisfy the formula (X), peeling is more likely to occur at high temperature and humidity because of the higher interfacial stress between the support and the undercoat layer. If the humidity-dependent change in the modulus of elastic deformation of the undercoat layer satisfies the formula (X), peeling is less likely to occur at high temperature and humidity because of the lower interfacial stress between the support and the undercoat layer.

The modulus of elastic deformation of the undercoat layer can be measured using, for example, an H100VP-HCU hardness tester available from Fischer. The universal hardness test (Martens' hardness test) is a measurement method standardized in ISO 14577 (JIS Z 2255:2003). A sample including a support and an undercoat layer formed thereon is prepared first. This sample is kept under a 23° C., 50% RH environment for 24 hours, and measurement is performed under the same environment. The undercoat layer of the sample under measurement is indented with a square-based pyramidal diamond indenter with an angle of 136° between opposite faces. With the load on the diamond indenter being maintained, the indentation depth is read by electrical sensing to determine the modulus of elastic deformation. The load on the diamond indenter is 10 mN, and the retention time is 10 seconds. By the above procedure, the modulus of elastic deformation of the undercoat layer under a 23° C., 50% RH environment is determined. Next, the sample is kept under a 50° C., 90% RH environment for 24 hours, and measurement is performed in the same manner to determine the modulus of elastic deformation of the undercoat layer after being left standing under a 50° C., 90% RH environment.

Next, an exemplary composition of an undercoat layer that satisfies the formula (X), which represents the change in modulus of elastic deformation depending on ambient changes, is illustrated below.

The undercoat layer according to this embodiment contains a silane coupling agent (a silane compound) having a divalent group represented by —NH—, metal oxide particles, and an urethane resin obtainable by polymerization of an isocyanate compound and a polyvinyl acetal resin.

To satisfy the formula (X), a compound (silane coupling agent) represented by the following formula (1) can be used as the silane coupling agent having a divalent group represented by —NH—.

[Chem. 1]

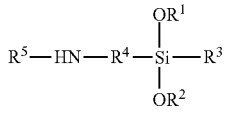

(1)

In the formula (1), $R^1$, $R^2$, and $R^3$ each independently represent an alkyl group having 1 to 3 carbon atoms. $R^4$ represents a divalent group represented by one of the following formulas (R4-1), (R4-2), and (R4-3). $R^5$ represents a hydrogen atom, a phenyl group, or an alkyl group having 1 to 3 carbon atoms.

[Chem. 2]

$$-(CH_2)_m- \quad \text{(R4-1)}$$

$$-(CH_2)_m-NH-R^6- \quad \text{(R4-2)}$$

$$-(CH_2)_m-NH-R^6-NH-R^7- \quad \text{(R4-3)}$$

In the formulas (R4-1), (R4-2), and (R4-3), m is an integer number selected from 1 to 3. $R^6$ and $R^7$ each independently represent an alkylene group having 1 to 4 carbon atoms.

Examples of silane coupling agents represented by the formula (1) include N-(2-aminoethyl)-3-aminopropylmethyldimethoxysilane, 3-aminopropylmethyldiethoxysilane, (phenylaminomethyl)methyldimethoxysilane, N-(2-aminoethyl)-3-aminoisobutylmethyldimethoxysilane, N-ethylaminoisobutylmethyldiethoxysilane, and N-methylaminopropylmethyldimethoxysilane, of which N-(2-aminoethyl)-3-aminopropylmethyldimethoxysilane is particularly preferred for improved resistance to peeling off the support and reduced potential variation.

The modulus of elastic deformation, measured by a universal hardness test, of the surface of an undercoat layer containing metal oxide particles whose surface is treated with a compound represented by the formula (1) satisfies the formula (X).

In contrast, the modulus of elastic deformation, measured by a universal hardness test, of the surface of an undercoat layer containing metal oxide particles whose surface is treated with N-(2-aminoethyl)-3-aminopropyltrimethoxysilane or 3-aminopropyltrimethoxysilane, as disclosed in PTL 1, does not satisfies the formula (X). That is, the modulus of elastic deformation (we/wt) measured under a 23° C., 50% RH environment after keeping under a 50° C., 90% RH environment is larger than the modulus of elastic deformation (we/wt) measured under a 23° C., 50% RH environment; the inequality sign is the opposite to that of the formula (X).

The inventors believe that the use of a compound represented by the formula (1) for the undercoat layer allows the modulus of elastic deformation of the surface of the undercoat layer to satisfy the formula (X) by the following mechanism.

As the surface of the metal oxide particles is treated with the compound represented by the formula (1), the molecules of the silane coupling agent are joined together in a linear or ring shape to form molecular layers (silane molecular layers) with relatively high elasticity. The highly elastic silane molecular layers are entangled with each other between the metal oxide particles. As moisture enters the undercoat layer at high temperature and humidity, the moisture is captured by the —NH— groups on the entangled, highly elastic silane molecular layers with high elasticity and decreases the elasticity of the silane molecular layers due to entanglement. That is, if the compound represented by the formula (1) is used, the silane molecular layers decrease their elasticity as moisture, which contributes to peeling, enters the undercoat layer at high temperature and humidity. This reduces the stress on the undercoat layer (decreases the modulus of elastic deformation of the undercoat layer), thus improving the resistance to peeling of the undercoat layer off the support.

In contrast, silane molecular layers of N-(2-aminoethyl)-3-aminopropyltrimethoxysilane or 3-aminopropyltrimethoxysilane are independent of each other without being entangled with each other; they form molecular layers (silane molecular layers) with relatively low elasticity. As moisture enters the undercoat layer at high temperature and humidity, the silane molecular layers do not function to reduce the stress on the undercoat layer and therefore do not improve the resistance to peeling of the undercoat layer off the support.

The urethane resin used for the undercoat layer is an urethane resin obtainable by polymerization of an isocyanate compound and a polyvinyl acetal resin.

The isocyanate compound used for the urethane resin in this embodiment is a compound having two or more isocyanate groups. Examples of isocyanate compounds include 2,4-tolylene diisocyanate, 2,6-tolylene diisocyanate, diphenylmethane-4,4'-diisocyanate, hexamethylene diisocyanate, adduct type of hexamethylene diisocyanate and trimethylolpropane, biuret type of hexamethylene diisocyanate, and isocyanurate type of hexamethylene diisocyanate. Blocked (stabilized) isocyanates are also available. Examples of blocked isocyanates include the above isocyanates stabilized by blocking with oximes. Examples of oximes include, but not limited to, formaldehyde oxime, acetaldoxime, methyl ethyl ketoxime, and cyclohexanone oxime.

The metal oxide particles used for the undercoat layer are preferably particles containing, for example, titanium oxide, zinc oxide, tin oxide, zirconium oxide, or aluminum oxide. More preferably, particles containing zinc oxide are used for reduced potential variation after repeated use under a high-temperature, high-humidity environment.

In this embodiment, the metal oxide particles can have a specific surface area of from 14 to 25 $m^2/g$. Metal oxide particles having a specific surface area within this range have a particle size appropriate for reduced potential variation after repeated use under a high-temperature, high-humidity environment.

The specific surface area of the metal oxide particles can be measured using, for example, a Tristar 3000 analyzer available from Shimadzu Corporation. In a glass cell for measurement, 200 mg of metal oxide particles are placed. This cell is pretreated by vacuum drying at 150° C. for 30 minutes and is set on the analyzer to measure the specific surface area of the metal oxide particles.

In this embodiment, a mixture of two or more types of metal oxide particles formed of different metal oxides or having different specific surface areas can be used. The undercoat layer can further contain metal oxide particles whose surface is treated with a silane coupling agent other than the silane coupling agent having a divalent group represented by —NH—. Examples of other silane coupling agents include vinyltrimethoxysilane, methyltrimethoxysilane, 3-glycidoxypropyltrimethoxysilane, 3-methacryloxypropyltrimethoxysilane, 3-chloropropyltrimethoxysilane, and 3-mercaptopropyltrimethoxysilane.

The amount of surface treatment with the compound represented by the formula (1) can be as follows. If the mass of the silane coupling agent represented by the formula (1) relative to the mass of the metal oxide particles is A mass %, and the specific surface area of the metal oxide particles is B $m^2/g$, the amount of surface treatment which is defined as A/B can satisfy the following formula (2):

$$0.010 \leq A/B \leq 0.050 \quad (2)$$

A value of A/B within the above range results in further improved resistance to peeling of the undercoat layer off the support under a high-temperature, high-humidity environment and further reduced potential variation after repeated use.

The content ratio of the surface-treated metal oxide particles to the urethane resin can be 2:1 to 4:1 (by mass).

Next, a method of producing the electrophotographic photosensitive member according to this embodiment will be described. The method of producing the electrophotographic photosensitive member according to this embodiment includes forming the undercoat layer directly on the metallic surface of the support and forming the photosensitive layer on the undercoat layer. The undercoat layer is formed by heat-drying a coat of an undercoat layer coating solution containing the isocyanate compound, the polyvinyl acetal resin, and the metal oxide particles whose surface is treated with the compound represented by the formula (1).

Alternatively, the undercoat layer is formed by heat-drying a coat of an undercoat layer coating solution prepared by mixing and dispersing the isocyanate compound, the polyvinyl acetal resin, the compound represented by the formula (1), and the metal oxide particles. In this case, the materials can be mixed in any order. The metal oxide particles, the isocyanate compound, and the polyvinyl acetal resin can be predispersed before the compound represented by the formula (1) is added thereto. Alternatively, a solution prepared by mixing the isocyanate compound and the polyvinyl acetal resin in advance can be used.

The surface of the metal oxide particles can be treated with the silane coupling agent in any known manner, for example, by a dry process or a wet process. The dry process involves adding an alcohol solution, organic solvent solution, or aqueous solution containing the silane coupling agent to the metal oxide particles and uniformly dispersing the particles with stirring in a mixer capable of high-speed stirring, such as a Henschel mixer, followed by drying. The wet process involves dispersing the metal oxide particles and the silane coupling agent in a solvent, for example, with stirring or by sand milling with glass beads, and removing the solvent by filtration or vacuum distillation. The removal of the solvent can be followed by baking at 100° C. or higher.

Next, the structure of the electrophotographic photosensitive member according to this embodiment will be described. The electrophotographic photosensitive member according to this embodiment includes a support having a metallic surface, an undercoat layer formed directly on the metallic surface of the support, and a photosensitive layer formed on the undercoat layer.

The photosensitive layer can be either a monolayer photosensitive layer, which is a single layer containing a charge generating material and a charge transporting material, or a layered (functionally divided) photosensitive layer, which includes a charge generating layer containing a charge generating material and a charge transporting layer containing a charge transporting material. In this embodiment, a layered (functionally divided) photosensitive layer can be used. The layered photosensitive layer can include the charge generating layer and the charge transporting layer in the above order. Optionally, a protective layer can be formed on the photosensitive layer.

The undercoat layer can include a plurality of layers. Optionally, a second undercoat layer can be disposed between the undercoat layer in contact with the metallic surface and the photosensitive layer.

Support

The support has a metallic surface. The support can be formed of, for example, aluminum, stainless steel, nickel, copper, zinc, or a conductive metal oxide. The support can also be a resin support coated with a film in which a conductive metal oxide is dispersed. The support can be cylindrical, belt-shaped, or sheet-shaped, and particularly, an aluminum cylinder can be used. An aluminum or aluminum alloy support can be an extruded and drawn (ED) or extruded and ironed (EI) pipe that is optionally subjected to cutting, electrochemical-mechanical polishing (electrolysis with an electrode and an electrolyte solution having an electrolytic action and polishing with an abrasive wheel having a polishing action), or wet or dry honing.

Undercoat Layer

The undercoat layer formed directly on the metallic surface of the support contains a silane coupling agent having a divalent group represented by —NH—, metal oxide particles, and an urethane resin obtainable by polymerization of an isocyanate compound and a polyvinyl acetal resin.

The undercoat layer can also contain additives. Examples of additives include known materials such as powdered metals (e.g., powdered aluminum), conductive materials (e.g., carbon black), electron transporting materials, fused polycyclic compounds, electron transporting pigments, metal chelate compounds, and organometallic compounds. Examples of electron transporting materials include benzophenone compounds having a hydroxy group and anthraquinones having a hydroxy group.

Examples of solvents used for the undercoat layer coating solution include organic solvents such as alcohols, ketones, ethers, esters, halogenated aliphatic hydrocarbons, and aromatic hydrocarbons. Examples of organic solvents include methylal, tetrahydrofuran, methanol, ethanol, isopropyl alcohol, butyl alcohol, methyl cellosolve, methoxypropanol, acetone, methyl ethyl ketone, cyclohexanone, methyl acetate, ethyl acetate, and dioxane. These solvents can be used alone or as a mixture.

Examples of devices for dispersing the undercoat layer coating solution include homogenizers, sonicators, paint shakers, ball mills, sand mills, roller mills, vibrating mills, attritors, and liquid-impact high-speed dispersers.

The undercoat layer can also contain organic resin particles or a leveling agent for purposes such as surface roughness adjustment and reduced cracking. Examples of organic resin particles include hydrophobic organic resin particles such as silicone particles and hydrophilic organic resin particles such as crosslinked poly(methyl methacrylate) (PMMA) particles. In particular, the use of PMMA particles improves adhesion between the undercoat layer and a charge generating layer formed thereon, thus reducing potential variation after repeated use of the photosensitive member.

The drying method used for forming the undercoat layer is, for example, heat-drying or blow-drying. The heating temperature can be from 100° C. to 200° C., depending on the polymerization (curing) temperature of the resin.

The undercoat layer preferably has a thickness of from 0.5 to 40 μm, more preferably from 10 to 30 μm.

Photosensitive Layer

The photosensitive layer is formed on the undercoat layer. Examples of charge generating materials used in this embodiment include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine pigments, anthanthrone pigments, pyranthrone pigments, xanthene dyes, quinoneimine dyes, and styryl dyes, of which phthalocyanine pigments and azo pigments are preferred, and phthalocyanine pigments are more preferred. An example of a phthalocyanine pigment is hydroxygallium phthalocyanine. These charge generating materials can be used alone or in combination.

For layered photosensitive layers, examples of binder resins used for the charge generating layer include polycarbonate resins, polyester resins, butyral resins, polyvinyl acetal resins, acrylic resins, vinyl acetate resins, and urea resins, of which butyral resins are preferred. These resins can be used alone or in combination as a mixture or copolymer. The content of the charge generating material in the charge generating layer can be from 0.3 to 10 parts by mass per part by mass of the binder resin.

The charge generating layer can be formed by applying a charge generating layer coating solution containing the charge generating material, the binder resin, and a solvent and drying the coat. Alternatively, the charge generating layer can be formed by evaporating the charge generating material.

Examples of devices for dispersion include homogenizers, sonicators, paint shakers, ball mills, sand mills, attritors, and roller mills.

Examples of solvents used for the charge generating layer coating solution include alcohol solvents, sulfoxide solvents, ketone solvents, ether solvents, ester solvents, and aromatic hydrocarbon solvents. The charge generating layer preferably has a thickness of from 0.01 to 5 μm, more preferably from 0.1 to 2.5 μm.

The charge generating layer can optionally contain various additives such as sensitizers, antioxidants, ultraviolet absorbers, plasticizers, and thickeners.

Examples of charge transporting materials used in this embodiment include triarylamine compounds, hydrazone compounds, stilbene compounds, pyrazoline compounds, oxazole compounds, thiazole compounds, triarylmethane compounds, enamine compounds, and butadiene compounds. These charge transporting materials can be used alone or in combination.

For layered photosensitive layers, examples of binder resins used for the charge transporting layer include acrylic resins, acrylonitrile resins, allyl resins, alkyd resins, epoxy resins, silicone resins, phenolic resins, phenoxy resins, polyacrylamide resins, polyacrylimide resins, polyamide resins, poly(aryl ether) resins, polyarylate resins, polyimide resins, polyurethane resins, polyester resins, polyethylene resins, polycarbonate resins, polysulfone resins, polyphenylene oxide resins, polybutadiene resins, polypropylene resins, and methacrylic resins. These resins can be used alone or in combination as a mixture or copolymer. Particularly preferred are polyarylate resins and polycarbonate resins.

The content of the charge transporting material in the charge transporting layer can be from 0.3 to 10 parts by mass per part by mass of the binder resin.

The charge transporting layer can be formed by applying a charge transporting layer coating solution containing the charge transporting material, the binder resin, and a solvent and drying the coat.

Examples of solvents used for the charge transporting layer coating solution include alcohol solvents, sulfoxide solvents, ketone solvents, ether solvents, ester solvents, and aromatic hydrocarbon solvents.

The charge transporting layer can optionally contain various additives such as antioxidants, ultraviolet absorbers, and plasticizers. The charge transporting layer preferably has a thickness of from 5 to 40 μm, more preferably from 10 to 30 μm.

In this embodiment, a protective layer can be provided on the charge transporting layer for purposes such as improved durability and ease of cleaning.

The protective layer can be formed by applying a protective layer coating solution containing a resin and an organic solvent and drying the coat.

Examples of resins used for the protective layer include polyvinyl butyral resins, polyester resins, polycarbonate resins, polyamide resins, polyimide resins, polyarylate resins, polyurethane resins, styrene-butadiene copolymers, styrene-acrylic acid copolymers, and styrene-acrylonitrile copolymers.

The protective layer can have charge transporting properties. Such a protective layer can be formed by curing a monomeric material having charge transporting properties or a polymeric charge transporting material through any crosslinking reaction. For example, the protective layer can be formed by polymerizing or crosslinking a charge transporting compound having a chain-polymerizable group. Examples of chain-polymerizable groups include acrylic, methacrylic, alkoxysilyl, and epoxy groups. Examples of curing reactions include radical polymerization, ionic polymerization, thermal polymerization, photopolymerization, radiation polymerization (electron beam polymerization), plasma-enhanced chemical vapor deposition (CVD), and photo-assisted CVD.

The protective layer can optionally contain additives such as conductive particles, ultraviolet absorbers, and wear resistance improvers. Examples of conductive particles include metal oxide particles such as tin oxide particles. Examples of wear resistance improvers include fluorinated resin particles such as polytetrafluoroethylene particles, alumina, and silica.

The protective layer preferably has a thickness of from 0.5 to 20 μm, more preferably from 1 to 10 μm.

The coating solutions for forming the layers described above can be applied by a coating process such as dip coating, spray coating, spinner coating, roller coating, Meyer bar coating, or blade coating.

Electrophotographic Apparatus

Figure 2:
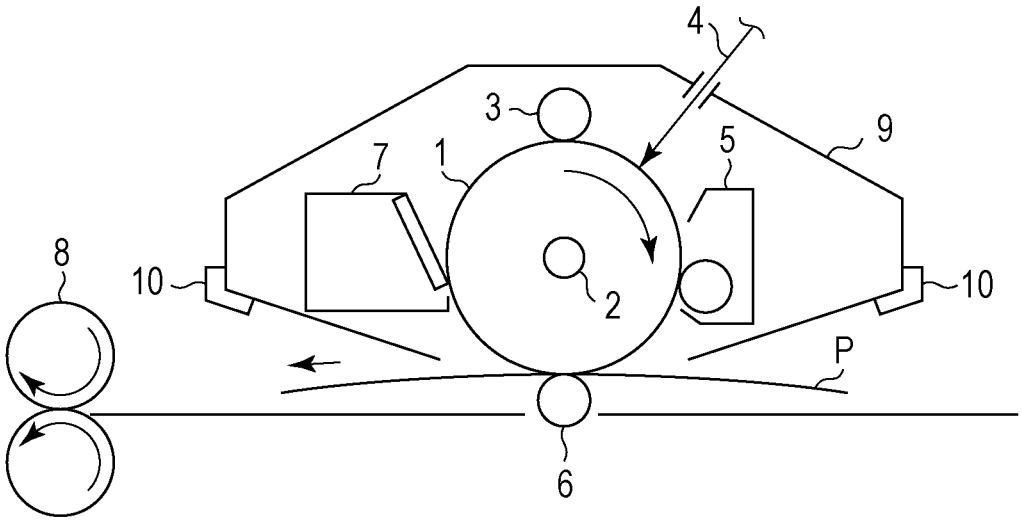
FIG. 2 is a schematic view showing an example of the structure of an electrophotographic apparatus equipped with a process cartridge including an electrophotographic photosensitive member according to an embodiment of the present invention.

FIG. 2 schematically shows an example of the structure of an electrophotographic apparatus equipped with a process cartridge including an electrophotographic photosensitive member according to an embodiment of the present invention.

In FIG. 2, a cylindrical electrophotographic photosensitive member 1 rotates about the axis of a shaft 2 at a predetermined peripheral speed in the direction indicated by the arrow. During rotation, the surface of the electrophotographic photosensitive member 1 is uniformly charged to a predetermined negative potential by a charging device (primary charging device such as a charging roller) 3. The electrophotographic photosensitive member 1 is then exposed to exposure light (image exposure light) 4 whose intensity is modified based on time-series electrical digital image signals for target image information. The exposure light 4 is output from an exposure device (not shown) such as a slit exposure device or laser-beam scanning exposure device. In this manner, an electrostatic latent image corresponding to the target image is formed on the surface of the electrophotographic photosensitive member 1.

The electrostatic latent image formed on the surface of the electrophotographic photosensitive member 1 is subjected to reversal development with a toner contained in a developer by a developing device 5 to form a toner image. The toner image is then transferred from the surface of the electrophotographic photosensitive member 1 to a transfer medium (such as paper) P by a transfer bias applied by a transferring device (such as a transferring roller) 6. The transfer medium P is picked up by a transfer medium feeder (not shown) and is fed to the position (contact area) between the electrophotographic photosensitive member 1 and the transferring device 6 in synchronism with the rotation of the electrophotographic photosensitive member 1. A bias voltage of opposite polarity to the charge carried by the toner is applied to the transferring device 6 by a bias power supply (not shown).

The transfer medium P having the toner image transferred thereto is released from the surface of the electrophotographic photosensitive member 1 and is transported to a fusing device 8, which fuses the toner image to the transfer medium P. The transfer medium P having the toner image formed thereon (print or copy) is transported outside the apparatus.

After the transfer of the toner image, a cleaning device (such as a cleaning blade) 7 removes residual developer (residual toner) from the surface of the electrophotographic photosensitive member 1. The surface of the electrophotographic photosensitive member 1 is then neutralized by preexposure light (not shown) emitted from a preexposure device (not shown) for use in the next image-forming cycle. As shown in FIG. 2, preexposure is unnecessary if the charging device 3 is a contact charging device such as a charging roller.

In this embodiment, a plurality of devices can be selected from components such as the electrophotographic photosensitive member 1, the charging device 3, the developing device 5, the transferring device 6, and the cleaning device 7 and be accommodated in a container and integrally supported as a process cartridge. The process cartridge can be configured to be detachably attachable to a main body of an electrophotographic apparatus such as a copier or a laser beam printer. In FIG. 2, the electrophotographic photosensitive member 1, the charging device 3, the developing device 5, and the cleaning device 7 are integrally supported as a process cartridge 9. The process cartridge 9 is detachably attachable to a main body of an electrophotographic apparatus using guiding devices 10, such as rails, disposed on the main body of the electrophotographic apparatus.

For example, if the electrophotographic apparatus is a copier or printer, the exposure light 4 is light reflected from or transmitted through an original document. Alternatively, the exposure light 4 is a laser beam scanned based on signals output from a sensor as it reads the original document, or is light emitted by driving, for example, a light-emitting diode (LED) array or a liquid crystal shutter array.

EXAMPLES

The present invention is further illustrated by the following non-limiting examples, where parts are by mass.

Example 1

To 500 parts of toluene were added with stirring 100 parts of zinc oxide particles (specific surface area=19 $m^2/g$, powder resistivity=$4.7\times10^6$ Ω·cm). To the mixture was added 0.75 part of a silane coupling agent having a divalent group represented by —NH— (N-(2-aminoethyl)-3-aminopropylmethyldimethoxysilane available under the trade name KBM602 from Shin-Etsu Chemical Co., Ltd.), and stirring was continued for 6 hours. After toluene was distilled off in vacuo, heat-drying was performed at 140° C. for six hours to yield surface-treated zinc oxide particles.

Next, to a mixture of 71.5 parts of methyl ethyl ketone and 71.5 parts of 1-butanol were added 81 parts of the surface-treated zinc oxide particles, 15 parts of a blocked isocyanate compound (available under the trade name Sumidur 3175 from Sumitomo Bayer Urethane Co. Ltd.), and 15 parts of a polyvinyl butyral resin (available under the trade name BM-1 from Sekisui Chemical Co., Ltd.), as a polyvinyl acetal resin. The mixture was dispersed in a sand mill with 0.8 mm glass beads at 23±3° C. for 3 hours. After dispersion, 0.01 part of silicone oil (available under the trade name SH28PA from Dow Corning Toray Silicone Co., Ltd.) and 5.6 parts of PMMA particles (available under the trade name TECHPOLYMER SSX-102 from Sekisui Plastics Co., Ltd., average primary particle size=2.5 μm) were added with stirring to yield an undercoat layer coating solution.

The resulting undercoat layer coating solution was applied to an aluminum sheet using a Meyer bar. The resulting coat was dried at 160° C. for 30 minutes to form an undercoat layer having a thickness of 18 μm. The undercoat layer, referred to as undercoat layer coat sample (A-1), was used for a universal hardness test and a peel test discussed later.

Electrophotographic photosensitive member (B-1) was produced as follows.

The resulting undercoat layer coating solution was applied to an aluminum cylinder (ED pipe having a diameter of 30 mm and a length of 357.5 mm available from Showa Denko K.K.) by dip coating. The resulting coat was heat-dried at 160° C. for 35 minutes to form an undercoat layer having a thickness of 18 μm. The mass of the silane coupling agent having a divalent group represented by —NH— (KBM602) on the surface-treated zinc oxide particles was 0.75% of the mass of the zinc oxide particles. Hence, the amount of surface treatment (A/B) of the zinc oxide particles was calculated as follows: A/B=0.75/19=0.039.

Next, to a solution of 5 parts of a polyvinyl butyral resin (available under the trade name S-LEC BX-1 from Sekisui Chemical Co., Ltd.) in 250 parts of cyclohexanone were added 10 parts of hydroxygallium phthalocyanine crystal (charge generating material) whose crystal form had intense peaks at 7.4° and 28.1° (Bragg angle 2θ±0.2°) in Cu-Kα characteristic X-ray diffraction and 0.1 part of the compound represented by the following structural formula (A). The mixture was dispersed in a sand mill with 0.8 mm glass beads at 23±3° C. for 3 hours. After dispersion, the mixture was diluted with 100 parts of cyclohexanone and 450 parts of ethyl acetate to yield a charge generating layer coating solution. The charge generating layer coating solution was applied to the undercoat layer by dip coating. The resulting coat was dried at 100° C. for 10 minutes to form a charge generating layer having a thickness of 0.18 μm.

[Chem. 3]

(A)

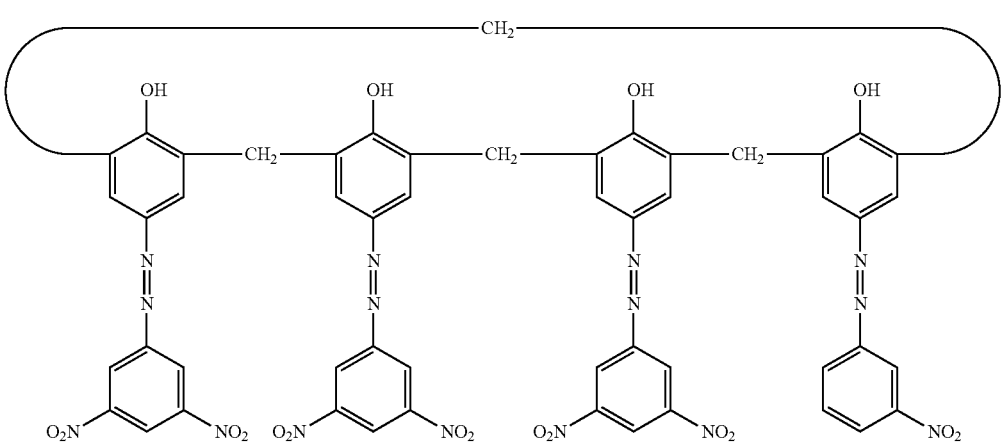

Next, a charge transporting layer coating solution was prepared by dissolving 50 parts of the compound (charge transporting material) represented by the following structural formula (B), 50 parts of the compound (charge transporting material) represented by the following structural formula (C), and 100 parts of a polycarbonate resin (available under the trade name Iupilon 2400 from Mitsubishi Engineering-Plastics Corporation) in a mixture of 650 parts of monochlorobenzene and 150 parts of dimethoxymethane. The charge transporting layer coating solution was applied to the charge generating layer by dip coating. The resulting coat was dried at 110° C. for 30 minutes to form a charge transporting layer having a thickness of 20 μm.

[Chem. 4]

(B)

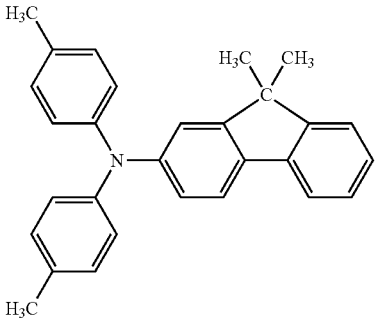

(C)

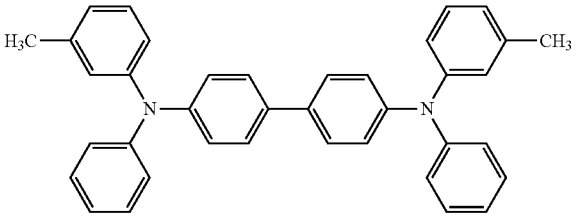

Next, a protective layer coating solution (second charge transporting layer coating solution) was prepared by adding 36 parts of the compound represented by the following structural formula (D) and 4 parts of a polytetrafluoroethylene resin fine powder (available under the trade name Lubron L-2 from Daikin Industries, Ltd.) to 60 parts of n-propyl alcohol and dispersing the mixture in an ultrahigh-pressure disperser.

[Chem. 5]

(D)

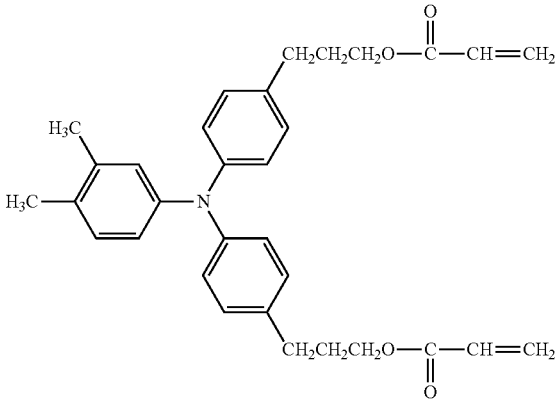

The protective layer coating solution was applied to the charge transporting layer by dip coating. After drying, the coat was irradiated with an electron beam at an acceleration voltage of 60 kV for 1.6 seconds in a nitrogen atmosphere to an absorbed dose of 8,000 Gy. The coat was then heated to 130° C. for 1 minute in a nitrogen atmosphere. During the electron beam irradiation and the heating for 1 minute, the oxygen concentration was 20 ppm. The coat was then heated to 110° C. for 1 hour in air to form a protective layer having a thickness of 5 μm. In this manner, electrophotographic photosensitive member (B-1) was produced, which included the undercoat layer, the charge generating layer, the charge transporting layer, and the protective layer formed on the support.

Example 2

An undercoat layer coating solution was prepared as in Example 1 except that 0.8 part of 1,2-dihydroxyanthraquinone (alizarin, available from Tokyo Chemical Industry Co., Ltd.) was added to the undercoat layer coating solution, and undercoat layer sheet sample (A-2) and electrophotographic photosensitive member (B-2) were produced.

Examples 3 to 5

Undercoat layer coating solutions were prepared as in Example 1 except that the mass of the silane coupling agent relative to the mass of the zinc oxide particles was changed as shown in Table 1, and undercoat layer sheet samples (A-3) to (A-5) and electrophotographic photosensitive members (B-3) to (B-5) were produced.

Example 6

The procedure of preparing the undercoat layer coating solution in Example 1 was changed as follows. In a sand mill with 0.8 mm glass beads were mixed 100 parts of a solution of 81 parts of the zinc oxide particles used in Example 1, 15 parts of a blocked isocyanate compound (available under the trade name Sumidur 3175 from Sumitomo Bayer Urethane Co. Ltd.), and 15 parts of a polyvinyl butyral resin (available under the trade name BM-1 from Sekisui Chemical Co., Ltd.) in 42.5 parts of methyl ethyl ketone and 42.5 parts of 1-butanol; 29 parts of methyl ethyl ketone; and 29 parts of 1-butanol.

To the mixture was added 0.75 part of a silane coupling agent (N-(2-aminoethyl)-3-aminopropylmethyldimethoxysilane). The mixture was dispersed in a sand mill with 0.8 mm glass beads for 3 hours. After dispersion, 0.01 part of silicone oil (SH28PA) and 5.6 parts of PMMA particles (average primary particle size=2.5 μm) were added with stirring to yield an undercoat layer coating solution. The resulting undercoat layer coating solution was used to produce undercoat layer sheet sample (A-6) and electrophotographic photosensitive member (B-6) as in Example 1.

Examples 7 and 8

Undercoat layer coating solutions were prepared as in Example 6 except that the mass of the silane coupling agent relative to the mass of the zinc oxide particles was changed as shown in Table 1, and undercoat layer sheet samples (A-7) and (A-8) and electrophotographic photosensitive members (B-7) and (B-8) were produced.

Example 9

An undercoat layer coating solution was prepared as in Example 1 except that the silane coupling agent having a divalent group represented by —NH— was changed to 3-aminopropyldiethoxymethylsilane (available from Tokyo Chemical Industry Co., Ltd.), and undercoat layer sheet sample (A-9) and electrophotographic photosensitive member (B-9) were produced.

Examples 10 to 12

Undercoat layer coating solutions were prepared as in Example 1 except that the specific surface area of the zinc oxide particles, used as the metal oxide particles, was changed as follows, and undercoat layer sheet samples (A-10) to (A-12) and electrophotographic photosensitive members (B-10) to (B-12) were produced. The zinc oxide particles in Example 10 had a specific surface area of 16 $m^2/g$ and a powder resistivity of $4.0\times10^7$ Ω·cm. The zinc oxide particles in Example 11 had a specific surface area of 22 $m^2/g$ and a powder resistivity of $2.3\times10^7$ Ω·cm. The zinc oxide particles in Example 12 had a specific surface area of 19 $m^2/g$ and a powder resistivity of $4.7\times10^6$ Ω·cm.

Example 13

An undercoat layer coating solution was prepared as in Example 1 except that the zinc oxide particles were changed to those having a specific surface area of 30 $m^2/g$ available under the trade name MZ-300 from Tayca Corporation and that the content of the silane coupling agent having a divalent group represented by —NH— was 1.2 parts, and undercoat layer sheet sample (A-13) and electrophotographic photosensitive member (B-13) were produced.

Example 14

An undercoat layer coating solution was prepared as in Example 1 except that the silane coupling agent having a divalent group represented by —NH— was changed to (phenylaminomethyl)methyldimethoxysilane (available from AZmax Co.), and undercoat layer sheet sample (A-14) and electrophotographic photosensitive member (B-14) were produced.

Examples 15 and 16

Undercoat layer coating solutions were prepared as in Example 14 except that the mass of the silane coupling agent relative to the mass of the zinc oxide particles was changed as shown in Tables 1 and 2, and undercoat layer sheet samples (A-15) and (A-16) and electrophotographic photosensitive members (B-15) and (B-16) were produced.

Example 17

An undercoat layer coating solution was prepared as in Example 1 except that 5.6 parts of the PMMA particles were replaced by 3.4 parts of silicone resin particles (available under the trade name Tospearl 145 from Momentive Performance Materials Inc., average primary particle size=4.5 μm), and undercoat layer sheet sample (A-17) and electrophotographic photosensitive member (B-17) were produced.

Example 18

An undercoat layer coating solution was prepared as in Example 1 except that the zinc oxide particles were replaced by titanium oxide particles (specific surface area=21 $m^2/g$, powder resistivity=$6.0\times10^5$ Ω·cm), and undercoat layer sheet sample (A-18) and electrophotographic photosensitive member (B-18) were produced.

Example 19

An undercoat layer coating solution was prepared as in Example 2 except that the 1,2-dihydroxyanthraquinone was replaced by 0.65 part of 2,3,4-trihydroxybenzophenone (available from Tokyo Chemical Industry Co., Ltd.), and undercoat layer sheet sample (A-19) and electrophotographic photosensitive member (B-19) were produced.

Example 20

An undercoat layer and a charge generating layer were formed on an aluminum cylinder (ED pipe) as in Example 1 using the undercoat layer coating solution prepared in Example 1.

Next, a charge transporting layer coating solution was prepared by dissolving 60 parts of the compound (charge transporting material) represented by the following structural formula (B), 30 parts of the compound (charge transporting material) represented by the following structural formula (C), 10 parts of the compound represented by the following structural formula (E), 100 parts of a polycarbonate resin (bisphenol Z polycarbonate resin available under the trade name Iupilon 2400 from Mitsubishi Engineering-Plastics Corporation), and 0.02 part of a polycarbonate having structural units represented by the following structural formula (F) (viscosity average molecular weight Mv=20,000) in a mixture of 600 parts of chlorobenzene and 200 parts of dimethoxymethane. The charge transporting layer coating solution was applied to the charge generating layer by dip coating to form a coat. The resulting coat was dried at 100° C. for 30 minutes to form a charge transporting layer having a thickness of 21 μm.

[Chem. 6]

(B)

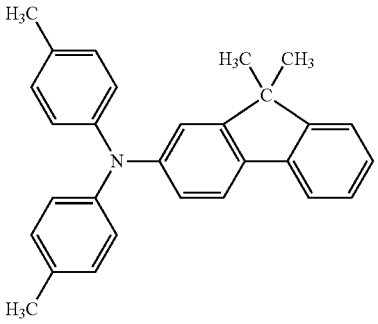

(C)

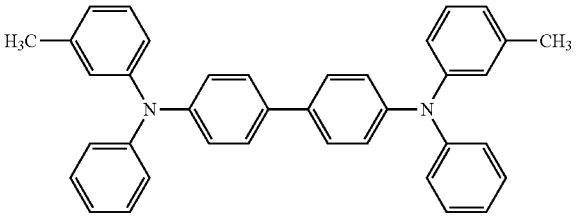

(E)

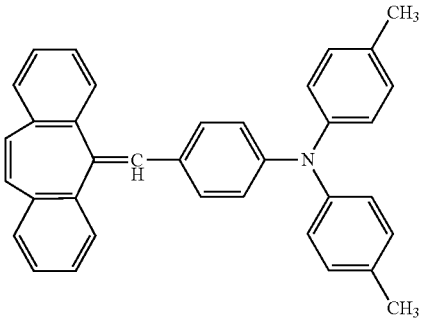

[Chem. 7]

(F)

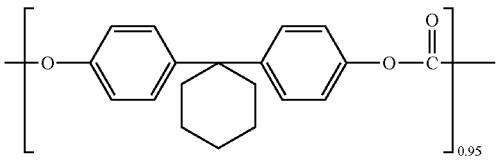

-continued

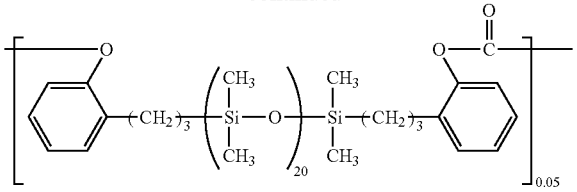

Next, a protective layer coating solution was applied to the charge transporting layer by the following procedure.

In a mixture of 45 parts of 1,1,2,2,3,3,4-heptafluorocyclopentane (available under the trade name ZEORORA H from Zeon Corporation) and 45 parts of 1-propanol were dissolved 1.5 parts of a fluorinated resin (available under the trade name GF-300 from Toagosei Co., Ltd.). To the solution were added 30 parts of an ethylene fluoride resin powder (available under the trade name Lubron L-2 from Daikin Industries, Ltd.). The mixture was passed through a high-pressure disperser (available under the trade name Microfluidizer M-110EH from Microfluidics Corporation, U.S.) to yield a dispersion. To the dispersion were added 70 parts of the hole transporting compound represented by the following formula (D), 30 parts of 1,1,2,2,3,3,4-heptafluorocyclopentane, and 30 parts of 1-propanol. The dispersion was filtered through a polyflon filter (available under the trade name PF-040 from Advantec Toyo Kaisha, Ltd.) to yield a protective layer coating solution.

[Chem. 5]

(D)

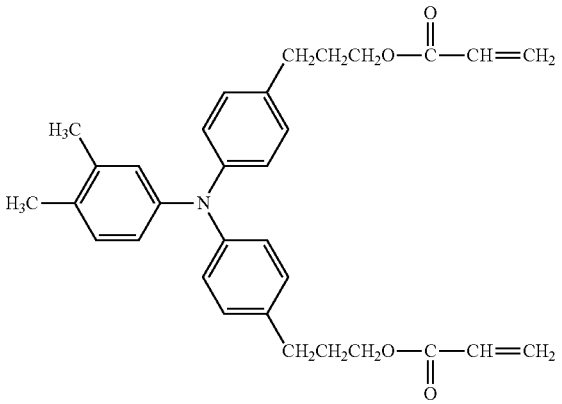

The protective layer coating solution was applied to the charge transporting layer by dip coating, and a protective layer having a thickness of 5 μm was formed under the same conditions as in Example 1. In this manner, electrophotographic photosensitive member (B-20) was produced, which included the undercoat layer, the charge generating layer, the charge transporting layer, and the protective layer formed on the support.

Comparative Example 1

An undercoat layer coating solution was prepared as in Example 4 except that the silane coupling agent having a divalent group represented by —NH— was changed to N-(2-aminoethyl)-3-aminopropyltrimethoxysilane (available under the trade name KBM603 from Shin-Etsu Chemical Co., Ltd.), and undercoat layer sheet sample (C-1) and electrophotographic photosensitive member (D-1) were produced.

Comparative Example 2

An undercoat layer coating solution was prepared as in Example 1 except that the silane coupling agent having a divalent group represented by —NH— was changed to N-phenyl-3-aminopropyltrimethoxysilane (available under the trade name KBM573 from Shin-Etsu Chemical Co., Ltd.), and undercoat layer sheet sample (C-2) and electrophotographic photosensitive member (D-2) were produced.

Comparative Example 3

An undercoat layer coating solution was prepared as in Comparative Example 2 except that the mass of the silane coupling agent relative to the mass of the zinc oxide particles was changed to 0.75 part, and undercoat layer sheet sample (C-3) and electrophotographic photosensitive member (D-3) were produced.

Comparative Example 4

An undercoat layer coating solution was prepared as in Example 1 except that the silane coupling agent was changed to one having no divalent group represented by —NH—(3-glycidyloxypropyl(dimethoxy)methylsilane, available from Tokyo Chemical Industry Co., Ltd.), and undercoat layer sheet sample (C-4) and electrophotographic photosensitive member (D-4) were produced.

Comparative Example 5

An undercoat layer coating solution was prepared as in Example 1 except that the silane coupling agent having a divalent group represented by —NH— was changed to 3-aminopropyltrimethoxysilane (available under the trade name KBM903 from Shin-Etsu Chemical Co., Ltd.), and undercoat layer sheet sample (C-5) and electrophotographic photosensitive member (D-5) were produced.

Comparative Example 6

The procedure of preparing the undercoat layer coating solution in Example 1 was changed as follows. Polyurethane resin A was prepared in the manner disclosed in Japanese Patent Laid-Open No. 2002-156772. Specifically, 228 parts of a polyol resin with a number average molecular weight of 800 formed by ring-opening polymerization of ϵ-caprolactone with bishydroxyethyl terephthalate, 8.1 parts of 1,4-butanediol, 4.0 g of trimethylolpropane, 1012.8 parts of cyclohexanone, and 0.034 part of dibutyltin dioctoate were uniformly mixed and dissolved. To the solution were added dropwise 97.5 parts of molten 4,4-diphenylmethane diisocyanate. The mixture was reacted at 70° C. for 12 hours to yield polyurethane resin A (solid content=25%, weight average molecular weight=30,000).

Next, to a mixture of 27 parts of cyclohexanone and 71 parts of methyl ethyl ketone were added 81 parts of the surface-treated zinc oxide particles in Example 1, 15 parts of diphenylmethane diisocyanate, and 60 parts of polyurethane resin A. The mixture was dispersed in a sand mill with 0.8 mm glass beads. After dispersion, 0.01 part of silicone oil (SH28PA) and 5.6 parts of PMMA particles (average primary particle size=2.5 μm) were added with stirring to yield an undercoat layer coating solution. The resulting undercoat layer coating solution was used to produce undercoat layer sheet sample (C-6) and electrophotographic photosensitive member (D-6) as in Example 1.

The evaluation methods will now be described below.

(1) Universal Hardness Test

The universal hardness test was performed by the measurement method standardized in ISO 14577 (JIS Z 2255:2003). The modulus of elastic deformation (we/wt) of undercoat layer sheet samples (A-1) to (A-19) and (C-1) to (C-6) was measured using a hardness tester (available under the trade name H100VP-HCU from Fischer). Each undercoat layer sheet sample was kept under a 23° C., 50% RH environment for 24 hours, and measurement was performed under the same environment. The undercoat layer of the sample under measurement was indented with a square-based pyramidal diamond indenter with an angle of 136° between opposite faces. With the load on the diamond indenter being maintained, the indentation depth was read by electrical sensing to determine the modulus of elastic deformation (we/wt). The load on the diamond indenter was 10 mN, and the retention time was 10 seconds.

By the above procedure, the modulus of elastic deformation under a 23° C., 50% RH environment was determined. Next, each undercoat layer sheet sample was kept under a 50° C., 90% RH environment for 24 hours and was left standing under a 23° C., 50% RH environment to allow the wet surface of the undercoat layer to dry. Measurement was performed in the same manner to determine the modulus of elastic deformation of the undercoat layer after being left standing under a 50° C., 90% RH environment. The results are shown in Tables 1 and 2. The modulus of elastic deformation did not vary with varying retention times within the range of from 5 minutes to 1 hour under a 23° C., 50% RH environment after keeping under a 50° C., 90% RH environment for 24 hours.

TABLE 1

| | Metal oxide | Specific surface area (B) | Silane coupling agent | Mass A (mass %) | Addition of silane coupling agent | A/B | we/wt at 23° C. and 50% | we/wt after keeping at 50° C. and 90% |
|---|---|---|---|---|---|---|---|---|
| Example 1 | ZnO | 19 | N-(2-Aminoethyl)-3-aminopropyl-methyldimethoxysilane | 0.75 | Treat particles | 0.039 | 28 | 25 |
| Example 2 | ZnO | 19 | N-(2-Aminoethyl)-3-aminopropyl-methyldimethoxysilane | 0.75 | Treat particles | 0.039 | 27 | 24 |
| Example 3 | ZnO | 19 | N-(2-Aminoethyl)-3-aminopropyl-methyldimethoxysilane | 0.30 | Treat particles | 0.016 | 26 | 25 |

TABLE 1-continued

| | Metal oxide | Specific surface area (B) | Silane coupling agent | Mass A (mass %) | Addition of silane coupling agent | A/B | we/wt at 23° C. and 50% | we/wt after keeping at 50° C. and 90% |
|---|---|---|---|---|---|---|---|---|
| Example 4 | ZnO | 19 | N-(2-Aminoethyl)-3-aminopropyl-methyldimethoxysilane | 1.10 | Treat particles | 0.058 | 28 | 25 |
| Example 5 | ZnO | 19 | N-(2-Aminoethyl)-3-aminopropyl-methyldimethoxysilane | 0.15 | Treat particles | 0.008 | 25 | 25 |
| Example 6 | ZnO | 19 | N-(2-Aminoethyl)-3-aminopropyl-methyldimethoxysilane | 0.75 | During dispersion | 0.039 | 27 | 24 |
| Example 7 | ZnO | 19 | N-(2-Aminoethyl)-3-aminopropyl-methyldimethoxysilane | 1.10 | During dispersion | 0.058 | 28 | 26 |
| Example 8 | ZnO | 19 | N-(2-Aminoethyl)-3-aminopropyl-methyldimethoxysilane | 0.15 | During dispersion | 0.008 | 25 | 25 |
| Example 9 | ZnO | 19 | 3-Aminopropyl-methyldiethoxysilane | 0.75 | Treat particles | 0.039 | 28 | 25 |
| Example 10 | ZnO | 16 | N-(2-Aminoethyl)-3-aminopropyl-methyldimethoxysilane | 0.75 | Treat particles | 0.047 | 27 | 24 |
| Example 11 | ZnO | 22 | N-(2-Aminoethyl)-3-aminopropyl-methyldimethoxysilane | 0.75 | Treat particles | 0.034 | 27 | 24 |
| Example 12 | ZnO | 24 | N-(2-Aminoethyl)-3-aminopropyl-methyldimethoxysilane | 0.75 | Treat particles | 0.031 | 26 | 23 |
| Example 13 | ZnO | 30 | N-(2-Aminoethyl)-3-aminopropyl-methyldimethoxysilane | 1.20 | Treat particles | 0.040 | 25 | 22 |

TABLE 2

| | Metal oxide | Specific surface area | Silane coupling agent | Mass A (mass %) | Addition of silane coupling agent | A/B | we/wt at 23° C. and 50% | we/wt after keeping at 50° C. and 90% |
|---|---|---|---|---|---|---|---|---|
| Example 14 | ZnO | 19 | (Phenylaminomethyl) methyldimethoxysilane | 0.75 | Treat particles | 0.039 | 28 | 24 |
| Example 15 | ZnO | 19 | (Phenylaminomethyl) methyldimethoxysilane | 1.10 | Treat particles | 0.058 | 29 | 26 |
| Example 16 | ZnO | 19 | (Phenylaminomethyl) methyldimethoxysilane | 0.15 | Treat particles | 0.008 | 26 | 26 |
| Example 17 | ZnO | 19 | N-(2-Aminoethyl)-3-aminopropyl-methyldimethoxysilane | 0.75 | Treat particles | 0.039 | 27 | 24 |
| Example 18 | $TiO_2$ | 21 | N-(2-Aminoethyl)-3-aminopropyl-methyldimethoxysilane | 0.75 | Treat particles | 0.036 | 20 | 18 |
| Example 19 | ZnO | 19 | N-(2-Aminoethyl)-3-aminopropyl-methyldimethoxysilane | 0.75 | Treat particles | 0.039 | 28 | 24 |
| Example 20 | ZnO | 19 | N-(2-Aminoethyl)-3-aminopropyl-methyldimethoxysilane | 0.75 | Treat particles | 0.039 | 28 | 25 |
| Comparative Example 1 | ZnO | 19 | N-(2-Aminoethyl)-3-aminopropyl-trimethoxysilane | 1.10 | Treat particles | 0.058 | 20 | 24 |
| Comparative Example 2 | ZnO | 19 | (Phenylaminopropyl)trimethoxysilane | 1.10 | Treat particles | 0.058 | 20 | 24 |
| Comparative Example 3 | ZnO | 19 | (Phenylaminopropyl)trimethoxysilane | 0.75 | Treat particles | 0.039 | 20 | 22 |
| Comparative Example 4 | ZnO | 19 | 3-Glycidyloxypropylmethyldimethoxysilane | 0.75 | Treat particles | 0.039 | 26 | 25 |
| Comparative Example 5 | ZnO | 19 | 3-Aminopropyl-trimethoxysilane | 0.75 | Treat particles | 0.039 | 21 | 25 |
| Comparative Example 6 | ZnO | 19 | N-(2-Aminoethyl)-3-aminopropyl-methyldimethoxysilane | 0.75 | Treat particles | 0.039 | 28 | 27 |

In Tables 1 and 2, the "metal oxide" column shows the type of metal oxide particles. The "we/wt at 23° C. and 50%" column shows the modulus of elastic deformation (we/wt) measured under a 23° C., 50% RH environment after keeping under the same environment for 24 hours. The "we/wt after keeping at 50° C. and 90%" column shows the modulus of elastic deformation (we/wt) measured after keeping under a 50° C., 90% RH environment for 24 hours.

(2) Peel Test

Each of undercoat layer sheet samples (A-1) to (A-19) and (C-1) to (C-6) was left standing under a high-temperature, high-humidity environment, i.e., a 50° C., 90% RH environment, for 72 hours and was removed therefrom. The undercoat layer sheet sample was then left standing under a normal-temperature, normal-humidity environment, i.e., a 23° C., 50% RH environment, to allow the wet surface of the undercoat layer sheet to dry so that a tape for use in the following peel test adhered firmly thereto. After 24 hours, the peel test was performed.

The peel test was performed by a cross-cut tape method in accordance with JIS K 5400. The test complied with the JIS specifications unless otherwise indicated. The measurement procedure was as follows.

1. A series of cuts each 2 mm apart were made at right angles on a fixed undercoat layer sheet sample using a cross-cut guide so as to reach the aluminum sheet, thus forming a grid of 100 squares.

2. The cuts were all made using an unused cutter knife. The cutter knife was held at a predetermined angle within the range of from 35° to 45° to the coat surface. Each cut was made through the coating at constant speed in about 0.5 second so as to reach the aluminum sheet.

3. An adhesive tape was bonded to the cut coat surface and was rubbed with an eraser so that the tape adhered to the coat. One to two minutes after the tape was bonded, an edge of the tape was pinched and held at a right angle to the coat surface, and the tape was quickly removed.

4. The coat surface and the tape were examined. The number of squares that peeled off was counted, and the percentage of the peeled area was calculated. In the peel test, a cross-cut test in accordance with the method disclosed in JIS was performed on the undercoat layer sheet samples, and the number of remaining squares out of 100 squares was counted. The percentage of the remaining squares was calculated as follows: percent adhesion (%)=number of remaining squares/total number of squares (100 squares). The evaluation results are shown in Table 3.

(3) Evaluation of Potential Variation after Repeated Use

A modified GP-40 electrophotographic copier available from CANON KABUSHIKI KAISHA was used as a test apparatus. The light source was changed to a 778 nm semiconductor laser with variable light intensity. The preexposure device was changed to a red LED. The motor was changed to a motor with variable process speed. The process speed was set to 471 mm/sec. Electrophotographic photosensitive members (B-1) to (B-20) and (D-1) to (D-6) were each mounted on a drum cartridge for the test apparatus.

The drum cartridge equipped with the electrophotographic photosensitive member and the test apparatus were left standing for one day under a normal-temperature, normal-humidity environment, i.e., a 23° C., 50% RH environment. Under the same environment, the charge potential (initial dark potential before repeated use) (VDa) was adjusted to −750 V, and the initial light potential (VLa) before repeated use was adjusted to −200 V. The intensity of the preexposure light was adjusted to three times the intensity of LED light that decreased a charge potential (VDa) of −750 V to −200 V (VLa).

The surface potential of the electrophotographic photosensitive member was measured as follows. A developing cartridge was detached from the test apparatus, and a potential probe (available under the trade name Model 6000B-8 from Trek, Inc.) was attached instead. The surface potential was measured using an electrostatic voltmeter (available under the trade name Model 344 from Trek, Inc.). The potential measurement system was configured by attaching the potential probe to the developing position of the developing cartridge. The potential probe was located in the center of the electrophotographic photosensitive member along the axis thereof at a distance of 3 mm from the surface of the electrophotographic photosensitive member.

Next, the evaluation procedure will be described. Each electrophotographic photosensitive member was evaluated under the initially set charging conditions and exposure conditions. A developing cartridge equipped with the electrophotographic photosensitive member was mounted on the test apparatus and was repeatedly used by continuously rotating the photosensitive member 75,000 revolutions under a normal-temperature, normal-humidity environment. After 75,000 revolutions, the test apparatus was left standing for 5 minutes. The developing cartridge was then replaced by the potential measurement system to measure the dark potential (VDb) and the light potential (VLb) under a normal-temperature, normal-humidity environment after repeated use. The difference between the light potential after repeated use and the initial light potential was calculated as the light potential variation ($\Delta VL=|VLb|-|VLa|$). The difference between the dark potential after repeated use and the initial dark potential was calculated as the dark potential variation ($\Delta VD=|VDb|-|VDa|$). The evaluation results are shown in Table 3.

In addition, each of unused electrophotographic photosensitive members (B-1) to (B-20) and (D-1) to (D-6) was mounted on a drum cartridge. The drum cartridge was left standing under a high-temperature, high-humidity environment, i.e., a 50° C., 90% RH environment, for 24 hours. After being removed therefrom, the drum cartridge was left standing under a normal-temperature, normal-humidity environment, i.e., a 23° C., 50% RH environment for a further 24 hours. A developing cartridge equipped with the electrophotographic photosensitive member was mounted on the test apparatus and was repeatedly used by continuously rotating the photosensitive member 75,000 revolutions under a normal-temperature, normal-humidity environment. The electrophotographic photosensitive member was evaluated under the initially set charging conditions and exposure conditions. After 75,000 revolutions, the test apparatus was left standing for 5 minutes. The developing cartridge was then replaced by the potential measurement system to measure the dark potential (VDb) and the light potential (VLb) after keeping under a high-temperature, high-humidity environment for 24 hours after repeated use. The difference between the light potential after repeated use and the initial light potential was calculated as light potential variation ($\Delta VL=|VLb|-|VLa|$). The difference between the dark potential after repeated use and the initial dark potential was calculated as dark potential variation ($\Delta VD=|VDb|-|VDa|$). The evaluation results are shown in Table 3.

TABLE 3

| | Percent adhesion after keeping at 50° C. and 90% | Potential variation at 23° C. and 50% | | Potential variation after keeping at 50° C. and 90% | |
|---|---|---|---|---|---|
| | | ΔVD | ΔVL | ΔVD | ΔVL |
| Example 1 | 100% | −5 | +4 | −4 | +7 |
| Example 2 | 100% | −6 | +3 | −5 | +9 |
| Example 3 | 100% | −10 | +1 | −11 | +7 |
| Example 4 | 96% | −6 | +8 | −12 | +14 |
| Example 5 | 95% | −16 | −3 | −13 | +22 |
| Example 6 | 100% | −6 | +4 | −3 | +10 |
| Example 7 | 95% | −7 | +7 | −13 | +13 |
| Example 8 | 95% | −17 | −4 | −11 | +20 |
| Example 9 | 100% | −7 | +8 | −5 | +10 |
| Example 10 | 100% | −8 | +5 | −8 | +9 |
| Example 11 | 100% | −6 | +7 | −10 | +10 |
| Example 12 | 100% | −5 | +7 | −9 | +11 |
| Example 13 | 100% | −5 | +12 | −10 | +20 |
| Example 14 | 100% | −4 | +15 | −12 | +16 |
| Example 15 | 97% | −6 | +18 | −13 | +22 |
| Example 16 | 95% | −19 | −5 | −15 | +25 |
| Example 17 | 100% | −6 | +5 | −5 | +7 |
| Example 18 | 93% | −18 | +15 | −19 | +28 |
| Example 19 | 100% | −5 | +5 | −4 | +6 |
| Example 20 | 100% | −4 | +4 | −3 | +6 |
| Comparative Example 1 | 0% | −8 | +8 | −30 | +50 |
| Comparative Example 2 | 4% | −9 | +19 | −36 | +66 |
| Comparative Example 3 | 6% | −11 | +15 | −32 | +55 |
| Comparative Example 4 | 100% | −11 | +8 | −22 | +43 |
| Comparative Example 5 | 0% | −10 | +11 | −25 | +53 |
| Comparative Example 6 | 71% | −13 | +30 | −27 | +88 |

In Table 3, the "percent adhesion after keeping at 50° C. and 90%" column shows the percent adhesion between the undercoat layer and the metallic surface of the support after being left standing under a high-temperature, high-humidity environment, i.e., a 50° C., 90% RH environment.

As shown in Table 3, the electrophotographic photosensitive members of Examples 1 to 20, which included an undercoat layer containing a silane coupling agent having a divalent group represented by —NH—, metal oxide particles, and an urethane resin and which satisfied the formula (X), showed significantly improved resistance to peeling of the undercoat layer off the support under a high-temperature, high-humidity environment and significantly reduced potential variation after repeated use. In contrast, for the electrophotographic photosensitive members of Comparative Examples 1 to 3 and 5, which included an undercoat layer containing a silane coupling agent having a divalent group represented by —NH—, metal oxide particles, and an urethane resin but which did not satisfy the formula (X), the undercoat layer peeled off the support under a high-temperature, high-humidity environment, and the potential variation after repeated use was insufficiently reduced. In Comparative Example 4, the use of a silane coupling agent having no divalent group represented by —NH— improved the resistance to peeling of the undercoat layer off the support under a high-temperature, high-humidity environment, although the potential variation after repeated use was insufficiently reduced. In Comparative Example 6, in which the urethane resin was not one obtainable from polymerization of an isocyanate compound and a polyvinyl acetal resin, the resistance to peeling of the undercoat layer off the support was higher than those of Comparative Examples 1 to 3 and 5, but was lower than those of the Examples, and a large potential variation occurred after repeated use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262128, filed Nov. 30, 2011 and No. 2012-254808, filed Nov. 21, 2012, which are hereby incorporated by reference herein in their entirety.

The invention claimed is:

1. An electrophotographic photosensitive member, comprising:

a support having a metallic surface, an undercoat layer directly on the metallic surface of the support, and a photosensitive layer on the undercoat layer, wherein, the undercoat layer comprises:

metal oxide particles whose surface have been treated with a compound represented by the following formula (1), and an urethane resin being obtained by polymerization of an isocyanate compound and a polyvinyl acetal resin, and a modulus of elastic deformation (we/wt) of a surface of the undercoat layer satisfies the following formula (X), the modulus of elastic deformation being measured by a universal hardness test:

(value of *we/wt* of surface of undercoat layer measured under 23° C., 50% RH environment after keeping under same environment for 24 hours)≥(value of *we/wt* of surface of undercoat layer measured under 23° C., 50% RH environment after keeping under 50° C., 90% RH environment for 24 hours) (X),

[Chem. 1]

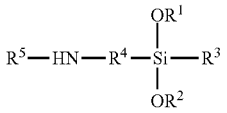

(1)

wherein, in the formula (1), $R^1$, $R^2$, and $R^3$ each independently represent an alkyl group having 1 to 3 carbon atoms, $R^4$ represents a divalent group represented by one of the following formulas (R4-1), (R4-2), and (R4-3), and $R^5$ represents a hydrogen atom, a phenyl group, or an alkyl group having 1 to 3 carbon atoms, and

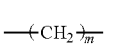

(R4-1)

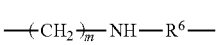

(R4-2)

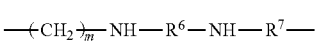

(R4-3)

wherein, in the formulas (R4-1), (R4-2), and (R4-3), m is an integer number selected from 1 to 3, and $R^6$ and $R^7$ each independently represent an alkylene group having 1 to 4 carbon atoms.

2. An electrophotographic photosensitive member according to claim 1, wherein, in the formula (1), $R^5$ is a hydrogen atom.

3. An electrophotographic photosensitive member according to claim 1, wherein if the mass of the compound represented by the formula (1) relative to the mass of the metal oxide particles is A mass %, and a specific surface area of the metal oxide particles is B $m^2/g$, the amount of surface treatment which is defined as A/B satisfies the following formula (2), and the value of B is from 14 to 25, $$0.010 \leq A/B \leq 0.050 \quad (2).$$

4. An electrophotographic photosensitive member according to claim 1, wherein, the undercoat layer further comprises at least one selected from the group consisting of a benzophenone compound having a hydroxy group and an anthraquinone compound having a hydroxy group.

5. A method of producing the electrophotographic photosensitive member according to claim 1, wherein, the method comprises the steps of:

preparing an undercoat layer coating solution by mixing:

the isocyanate compound, the polyvinyl acetal resin, and the metal oxide particles whose surface is treated with the compound represented by the formula (1), forming a coat for the undercoat layer by using the undercoat layer coating solution, and forming the undercoat layer by heat-drying of the coat.

6. A method of producing the electrophotographic photosensitive member according to claim 1, wherein, the method comprises the steps of:

preparing an undercoat layer coating solution by mixing and dispersing:

the isocyanate compound, the polyvinyl acetal resin, the compound represented by the formula (1), and the metal oxide particles, forming a coat for the undercoat layer by using the undercoat layer coating solution, and forming the undercoat layer by heat-drying of the coat.

7. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

8. An electrophotographic apparatus comprising:

the electrophotographic photosensitive member according to claim 1;

a charging device;

an exposure device;

a developing device; and a transferring device.

9. An electrophotographic photosensitive member according to claim 1, wherein, the undercoat layer further comprises at least one selected from the group consisting of a benzophenone compound having a hydroxy group and an anthraquinone compound having a hydroxy group.

10. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

11. An electrophotographic apparatus comprising:

the electrophotographic photosensitive member according to claim 1;

a charging device;

an exposure device;

a developing device; and a transferring device.

* * * * *